US007154390B2

(12) United States Patent
Giermanski et al.

(10) Patent No.: US 7,154,390 B2
(45) Date of Patent: Dec. 26, 2006

(54) SYSTEM, METHODS AND COMPUTER PROGRAM PRODUCTS FOR MONITORING TRANSPORT CONTAINERS

(75) Inventors: James R. Giermanski, Belmont, NC (US); Philippus Lodewyk Jacobus Smith, Waterkloof (ZA); Vincent Rigardo Van Rooyen, Centurion (ZA)

(73) Assignee: Powers International, Inc., Belmont, NC (US)

( * ) Notice: Subject to any disclaimer, the term of this patent is extended or adjusted under 35 U.S.C. 154(b) by 215 days.

(21) Appl. No.: 10/500,097

(22) PCT Filed: Mar. 18, 2004

(86) PCT No.: PCT/US2004/008068

§ 371 (c)(1),
(2), (4) Date: Jun. 24, 2004

(87) PCT Pub. No.: WO2005/008609

PCT Pub. Date: Jan. 27, 2005

(65) Prior Publication Data

US 2005/0110635 A1 May 26, 2005

(51) Int. Cl.
*G08B 1/08* (2006.01)

(52) U.S. Cl. ..... 340/539.22; 340/545.1; 340/550; 340/541

(58) Field of Classification Search ..... 340/541, 340/545.1, 989, 825.49, 626, 992, 540, 577, 340/635, 636, 539.22, 550
See application file for complete search history.

(56) References Cited

U.S. PATENT DOCUMENTS 3,618,067 A 11/1971 DeVale et al.
3,665,312 A 5/1972 Jarvis
3,893,069 A 7/1975 Mason
3,961,323 A 6/1976 Hartkorn
4,562,664 A 1/1986 Kambic
4,686,792 A 8/1987 Terrian
4,908,629 A 3/1990 Apsell et al.
4,924,206 A 5/1990 Ayers
5,126,719 A 6/1992 DeSorbo
5,187,381 A 2/1993 Iwasa et al.
5,223,844 A 6/1993 Mansell et al.

(Continued)

FOREIGN PATENT DOCUMENTS

WO WO 02/076850 A1 10/2002

(Continued)

OTHER PUBLICATIONS

International Search Report, mailed Dec. 3, 2004.

*Primary Examiner*—Anh V. La
(74) *Attorney, Agent, or Firm*—Alston & Bird LLP

(57) ABSTRACT

The present invention provides a system for monitoring access to a transport container. The system includes a monitoring unit secured to the transport container and at least one sensor in operable communication with the monitoring unit. The sensor is structured to detect incidents of access to the transport container and to communicate data corresponding to the incidents to the monitoring unit. The system includes at data key configured to communicate with the monitoring unit. The data key is capable of being configured as an activation key and/or a deactivation key. The activation key is configured to activate the monitoring unit so that the monitoring unit begins to monitor access to the transport container. The deactivation key is configured to deactivate the monitoring unit. The monitoring unit is configured to communicate data corresponding to the access incidents to the deactivation key.

35 Claims, 10 Drawing Sheets

U.S. PATENT DOCUMENTS 5,226,256 A 7/1993 Fries et al.
5,247,279 A 9/1993 Sato
5,319,698 A 6/1994 Glidewell et al.
5,327,118 A 7/1994 Drucker et al.
5,406,261 A 4/1995 Glenn
5,543,776 A 8/1996 L'Esperance et al.
5,570,079 A 10/1996 Dockery
5,615,247 A 3/1997 Mills
5,729,199 A 3/1998 Cooper et al.
5,917,433 A * 6/1999 Keillor et al. ..... 340/989
5,939,982 A 8/1999 Gagnon et al.
6,040,771 A * 3/2000 Kim ..... 340/545.1
6,133,842 A * 10/2000 Gariepy ..... 340/689
6,137,402 A * 10/2000 Marino ..... 340/506
6,185,773 B1 * 2/2001 Goedde ..... 340/540
6,265,973 B1 7/2001 Brammall et al.
6,472,985 B1 10/2002 Bruwer
6,633,239 B1 * 10/2003 Plude et al. ..... 340/945
6,701,231 B1 3/2004 Borugian
2004/0056767 A1 3/2004 Porter

FOREIGN PATENT DOCUMENTS

WO WO 02/096725 A2 12/2002

* cited by examiner

SYSTEM, METHODS AND COMPUTER PROGRAM PRODUCTS FOR MONITORING TRANSPORT CONTAINERS

BACKGROUND OF THE INVENTION

1. Field of the Invention

The present invention relates to systems, processes, and computer program products for freight transportation and, in particular, for monitoring transport containers.

2. Description of Related Art

Security in the freight transportation industry is of great concern. Freight transportation companies and their customers are constantly concerned with products being surreptitiously removed from freight and shipping containers, railcars, trailers, or other enclosures used to store and transport products (collectively referred to herein as "transport containers"). Freight transportation companies and governmental agencies are also concerned with contraband or harmful substances or devices, such as illegal drugs, weapons of mass destruction or even illegal immigrants, being surreptitiously placed within transport containers. As a result, freight transportation companies and governmental agencies routinely use security devices, such as locks, plastic and metal loop seals and cable seals, bolt seals, security tape, security tags and memory buttons that allow tracking of transport containers, and temperature monitors, all in an effort to prevent unauthorized access to transport containers. As used herein, "access to" is intended to include physical access or entry into the interior of a transport container and/or tampering with or other manipulations of the exterior of a transport container for the purpose of gaining physical access or entry into the interior of the transport container.

However, conventional security devices are by no means fool proof. Moreover, while conventional security devices may allow a freight transportation company or governmental agency to identify unauthorized access to a transport container, such devices typically do not provide any other pertinent information, such as information relating the contents of the transport container, the individual(s) that sealed and unsealed the container for the transportation company, when and where the transport container was accessed, to what extent and for how long the perpetrator(s) obtained access to the transport container, etc. This is particularly the case when the transport container has been shipped or transported by more than one freight transportation company, to multiple destinations, and/or to multiple countries. Consequently, even when unauthorized access to a transport container can be identified, which is not always the case, it can be difficult to ascertain any other information regarding the access incident that may assist the freight transportation company and/or a governmental agency in evaluating what, if any, actions can be or need to be taken regarding the access incident, such as enforcement actions to identify the perpetrator(s), precautions for biological or hazardous material contamination or weapons of mass destruction, or remedial actions to prevent future access incidents.

Accordingly, there remains a need for improved security devices and methods for monitoring transport containers. Such devices and methods should be capable of not only detecting access to the transport container, but also when and where the access incident occurred, how long the perpetrator (s) obtained access to the transport container, as well as other pertinent information regarding the contents of the transport container and access incident. The improved security devices and methods should be capable of notifying or alerting interested parties, such as the freight transportation company and/or government agencies, when a transport container has been accessed, as well as providing pertinent information relating to the access incident to the interested parties. In addition, the improved security devices and methods also should be capable of preventing unauthorized tampering with the security device.

BRIEF DESCRIPTION OF THE SEVERAL VIEWS OF THE DRAWINGS

Reference will now be made to the accompanying drawings, which are not necessarily drawn to scale, and wherein.

DETAILED DESCRIPTION OF THE INVENTION

The present invention now will be described more fully hereinafter with reference to the accompanying drawings, in which some, but not all embodiments of the invention are shown. Indeed, this invention may be embodied in many different forms and should not be construed as limited to the embodiments set forth herein; rather, these embodiments are provided so that this disclosure will satisfy applicable legal requirements. Like numbers refer to like elements throughout.

Figure 1:
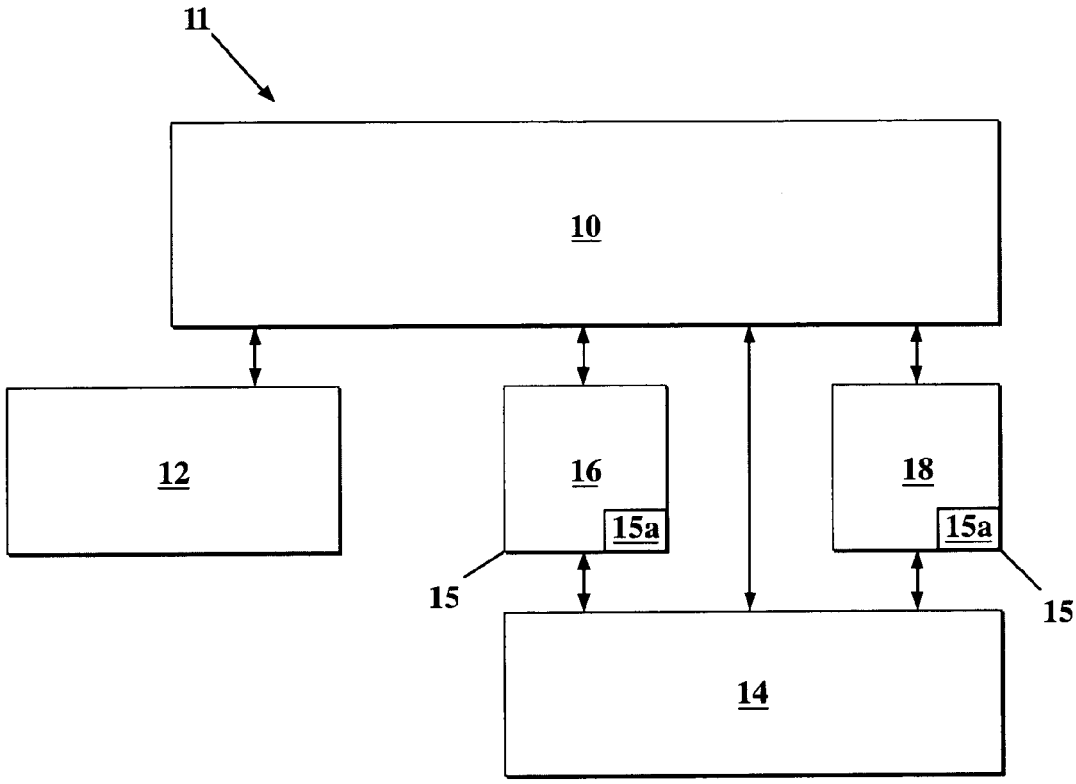
FIG. 1 shows a schematic block diagram of a system for monitoring access to a transport container, according to one embodiment of the present invention.

Referring to FIG. 1, there is illustrated a system 11 for monitoring access to a transport container, according to one embodiment of the present invention. The system 11 includes a monitoring unit 10 secured to the transport container (not shown) and at least one sensor 12 for detecting access to the transport container. Each sensor 12 is in operable communication with the monitoring unit 10 through suitable wiring or using wireless communications. The monitoring unit 10 and each sensor 12 are operably mounted or secured to the transport container so as to prevent damage to the monitoring unit and/or the sensor(s) from the cargo or products stored within the container and to ensure that the sensor(s) can detect access to the transport container. Preferably, the monitoring unit 10 is inconspicuously located within the transport container, such as a location that is not readily visible. The sensors 12 can include, but are not limited to, optical sensors (such as infrared motion sensors, pyroelectic sensors, and light-intensity sensors), temperature sensors, sound sensors, vibration sensors, magnetic switches, radiation sensors, location sensors (such as a global positioning system), as well as other sensors that are sensitive to chemical, temperature, strain, electrical, magnetic, motion, etc. changes associated with the transport container or with the environment within the interior of the container.

The system 11 includes an interface unit 14 in operable communication with the monitoring unit 10. The interface unit 14 and the monitoring unit 10 preferably communicate through wireless communications, including without limitation, radio-frequency communications, low-earth orbiting satellite communications (such as used by Orbcomm), geosynchronous satellite communications, mobile telephony, etc. The system 11 also includes one or more data keys 15 that are configured to communicate with the monitoring unit 10 and the interface unit 14. The data keys 15 are capable of being configured as an activation key 16 and/or a deactivation key 18. The activation key 16 is configured to activate the monitoring unit 10 so that the monitoring unit begins to monitor access to the transport container. The deactivation key 18 is configured to deactivate the monitoring unit 10. Each data key 15 includes a data repository 15*a*, which comprises computer-readable memory.

Figure 2:
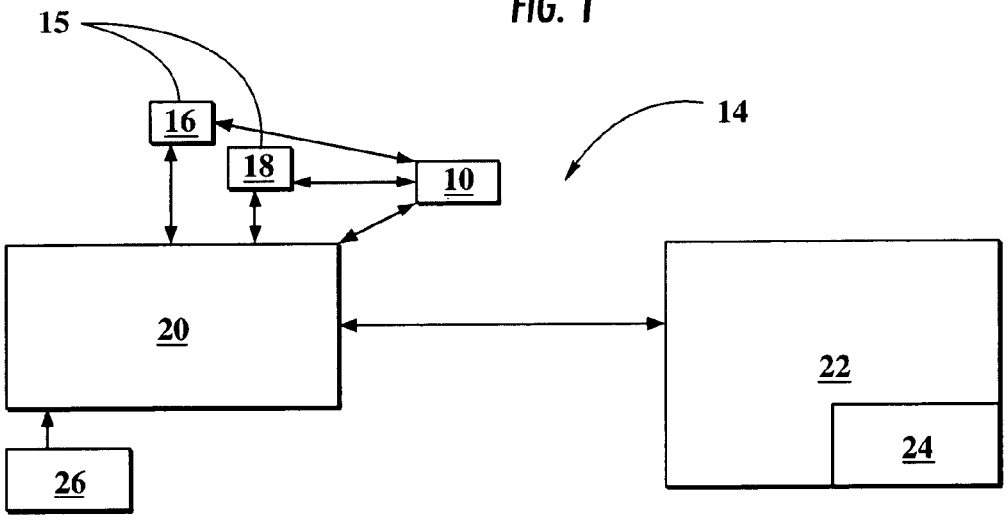
FIG. 2 shows a schematic block diagram of an interface unit, according to one embodiment of the present invention.

Referring to FIG. 2, there is illustrated the interface unit 14, according to one embodiment of the present invention. The interface unit 14 includes one or more programming units 20 that are configured to communicate with the monitoring unit 12. For example, each programming unit 20 can comprise a mobile, handheld device that includes an appropriate housing (not shown) and power supply 26, such as batteries. Each programming unit 20 preferably is configured to communicate with the monitoring unit 10 using wireless communications, such as radio-frequency communications. According to one embodiment, each programming unit 20 communicates with the monitoring unit 20 at a radio frequency of approximately 433 MHz. In another embodiment, each programming unit 20 is configured to communicate with the monitoring unit 20 at two or more different radio frequencies. Advantageously, this latter embodiment allows the system 11 to function in countries having different radio-frequency spectrum allocations or requirements.

Each programming unit 20 of the interface unit 14 is structured to configure a data key 15 into an activation key 16 by communicating to the data key an activation code and data corresponding to the cargo within the transport container. For example, for a transport container being transported by ship, this data can include the cargo manifest, the name of the vessel, the nationality of the vessel, the name of the master, the port of loading, the port of discharge, the date of departure from port of loading, the time of departure from port of loading, the voyage number, etc. Analogous data can be compiled for other types of transport containers, such as trailers, railcars, transport containers traveling via air, etc. The activation code preferably comprises a unique encrypted code associated with the operator of the interface unit 14 (i.e., the programming unit 20) configuring the data key 15 as an activation key 16. For example, the activation code can be generated based at least in part on the operator's username and password. As illustrated in FIGS. 1 and 2, the activation key 16 is configured to communicate the activation code and data corresponding to the transport container to the corresponding monitoring unit 10. Advantageously, the activation code allows the transport company to identify the individual responsible for securing the transport container and activating the monitoring unit 10, which places accountability on the individual thereby insuring that the individual will give proper attention to the task of confirming the contents of the transport container prior to securing the container and activating the monitoring unit.

Each programming unit 20 of the interface unit 14 is also structured to configure a data key 15 into a deactivation key 18 by communicating to the data key a deactivation code. The deactivation code preferably comprises a unique encrypted code associated with the operator of the interface unit 14 (i.e., the programming unit 20) configuring the data key 15 as a deactivation key 18. For example, the deactivation code can be generated based at least in part on the operator's username and password. As illustrated in FIGS. 1 and 2, the deactivation key 18 is configured to communicate the deactivation code to the corresponding monitoring unit 10. Advantageously, the deactivation code allows the transport company to identify the individual responsible for opening the transport container and deactivating the monitoring unit 10, which places accountability on the individual thereby insuring that the individual will give proper attention to the task of confirming the contents of the transport container subsequent to deactivating the monitoring unit.

The interface unit 14 also includes a controller 22, such as a processor or computer operating under software control. The controller 22 is in operable communication with each programming unit 20 through a wired and/or wireless communications connection, such as a local area network, a wide area network, the Internet, satellite, modular telephony, etc., so that the programming unit can communicate to the controller 22 pertinent data, such as the activation codes, deactivation codes, data corresponding to the transport container and/or data corresponding to incidents of access to the transport container. The data corresponding to the incidents of access will depend upon the type of sensor(s) 12 used in connection with the monitoring unit 10, but generally will include the date, time, and duration of the access incident, as well as the location of the transport container at the time of the access incident. The controller 22 preferably includes a data repository 24 comprising computer-readable memory to store the data communicated to the controller 22 by the programming unit 20. The controller 22 can be configured to communicate via a wired and/or wireless communications connection, such as a local area network, a wide area network, the Internet, satellite, modular telephony, etc., all or a portion of the data received from the programming unit 20 to interested parties, such as the owner of the cargo in the transport container, governmental agencies (such as the U.S. Department of Homeland Security, Bureau of Customs and Border Protection, or a equivalent foreign agency, etc.). The provision of this data in a timely fashion to the requisite governmental authorities can facilitate the transport container passing local customs efficiently and in a reasonable amount of time.

Figure 2A:
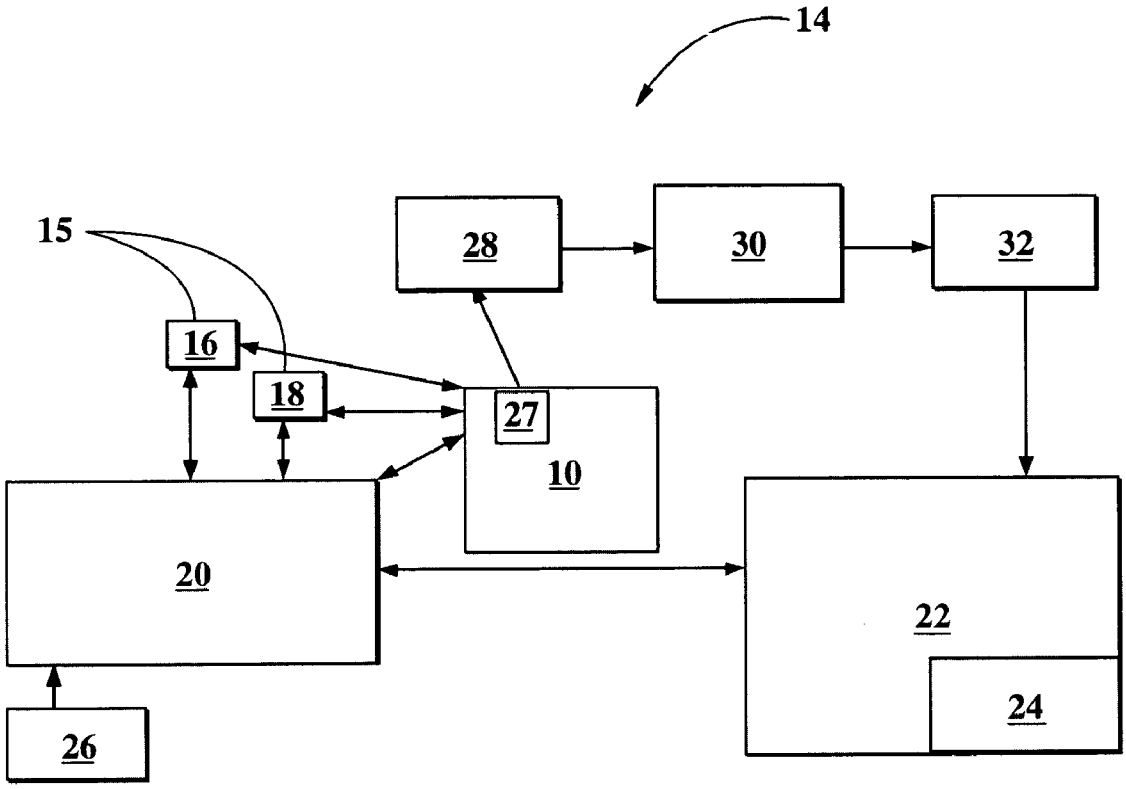
FIG. 2A shows a schematic block diagram of an interface unit, according to another embodiment of the present invention.

Optionally, as illustrated in FIG. 2A, the monitoring unit 10 can be configured to communicate directly with the controller 22 through a satellite communications connection. While a geosynchronous satellite or satellite network may be used, a low-earth satellite network (such as used by Orbcomm) is preferred since such networks do not generally entail the problems associated with geosynchronous satellites, such as line-of-site communication and high power requirements. According to this embodiment, the monitoring unit 10 includes a transmitter or other communications device 27 that is configured to communicate data corresponding to any access incidents to a relay unit 28 (such as using radio-frequency communications) that is in turn configured to communicate the data to a satellite or satellite network 30. The satellite or satellite network 30 communicates the data to a satellite ground-station 32, which in turn communicates the data to the controller 22 via a wired and/or wireless communications connection. Alternatively, the satellite ground-station 32 can communicate the data to another controller (not shown) which then communicates the data to the controller 22 via a wired and/or wireless communications connection.

Figure 3:
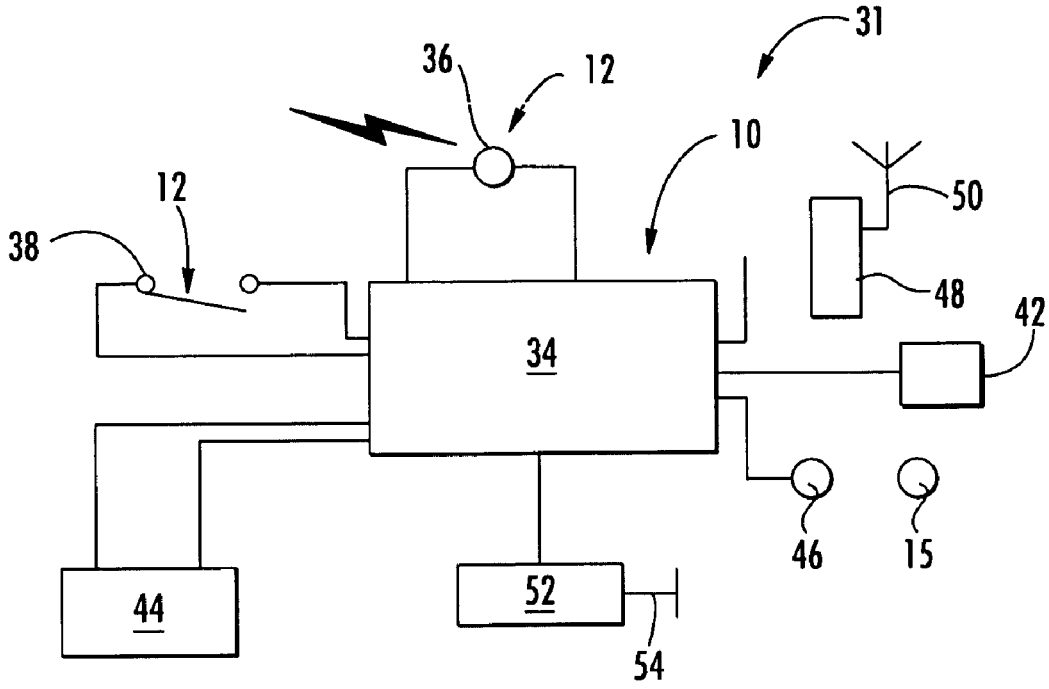
FIG. 3 shows a schematic block diagram of a system for monitoring access to a transport container, according to another embodiment of the present invention.

Referring to FIGS. 3 and 5, there is illustrated a system 31 for monitoring access to a transport container, according to one embodiment of the present invention. The system 31 includes a monitoring unit 10. The monitoring unit 10 includes a housing 34 constructed of metal or a durable plastic material. The system 31 also includes sensors 12, such as the light-sensitive resistor 36 and a door mounted magnetic switch 38, for sensing when the doors of the transport container are opened, or when light enters the transport container, of when the transport container is exposed to a direct heat source like a cutting torch, or the like. As discussed above, other types of sensors 12 can also be used.

As illustrated in FIG. 3, the monitoring unit 10 includes a controller 40, such as a processor operating under software control. The controller 40 includes a data repository 42 comprising computer-readable memory that is in operable communication with the controller 40. The monitoring unit 10 further includes a power source 44, such as a battery, for providing electrical power to the controller 40. The monitoring unit 10 includes a data transfer interface 46 for communicating with the data keys 15 (i.e., activation keys 16 and deactivation keys 18). As discussed above, each data key 15 has computer-readable memory 15*a* which is accessible by the data transfer interface 46 of the monitoring unit 10 through a plug-in connection, such as by a single-wire data serial communications protocol. The monitoring unit 10 includes a transmitter 48, such as a radio-frequency transmitter, having an antenna 50 which is mountable on the inside or outside of the transport container. The frequency range of the transmitter 48 can depend upon available frequencies, which can depend upon the geographical location of the transport container. Preferably, the frequency range of the transmitter 48 is selected based upon the frequency range specified by the applicable radio-frequency identification authority. For example, in one embodiment, the frequency range is approximately 433 MHz. According to other embodiments, the transmitter 48 is configured to communicate on two or more frequencies. The monitoring unit 10 further includes a receiver 52, such as a low-frequency, radio-frequency receiver, having an antenna 54 which is also mounted on the inside or outside of the transport container. The controller 40, data repository 42, power supply 44, transmitter 48, and receiver 52 are preferably sealed within the housing 34 to protect the components.

Figure 5A:
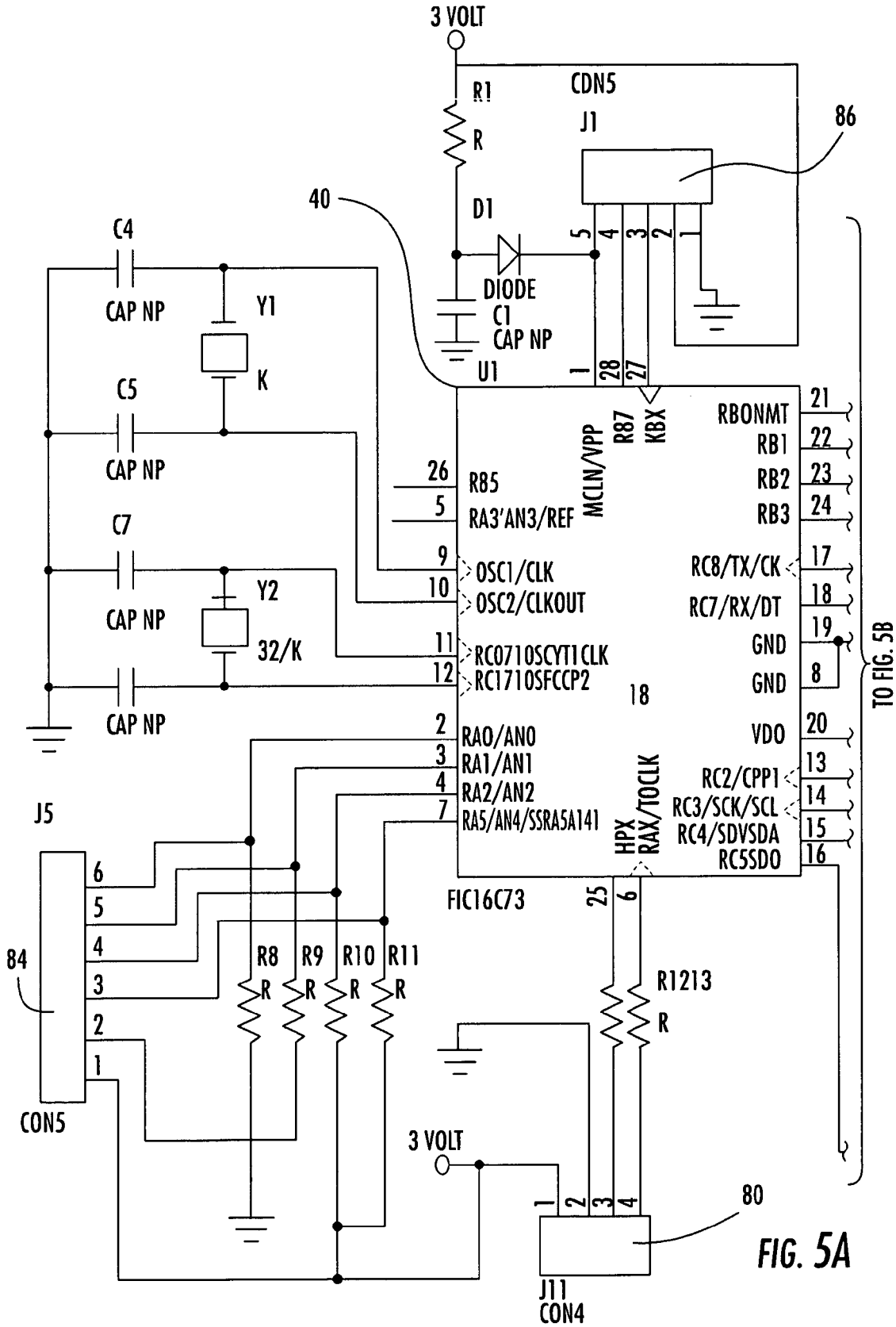
FIGS. 5A and 5B show a circuit diagram of the monitoring unit, according to one embodiment of the present invention.
Figure 5B:
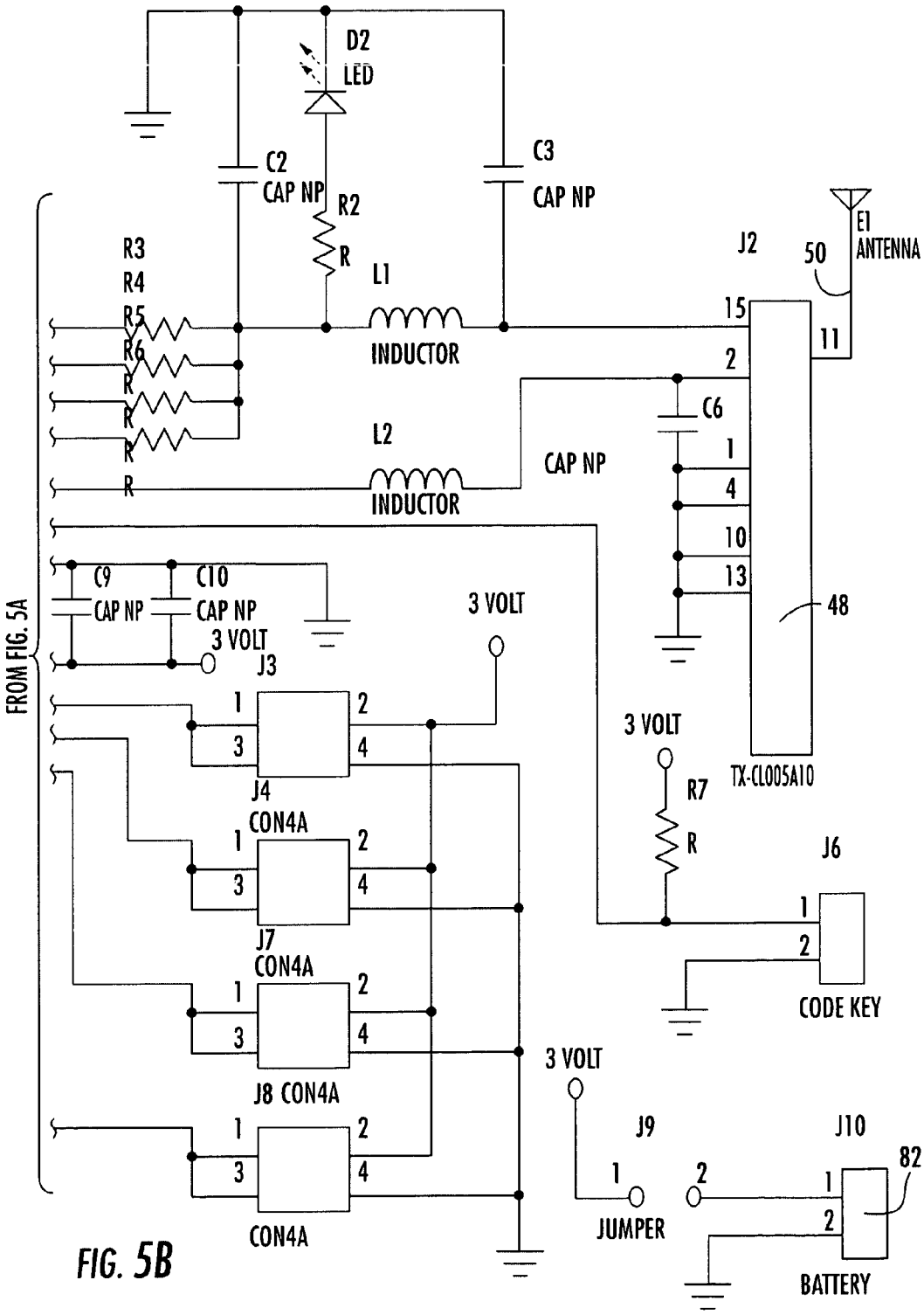

Referring to FIGS. 5A and 5B, there is illustrated the internal circuit diagram of a monitoring unit 10, according to one embodiment of the present invention. The controller 40 receives power from the power supply 44 via connector 82. A light emitting diode (LED) indicator (not shown) is installed to be visible from inside the transport container and is connected via connector 80 to the controller 40. The transmitter 48 and its antenna 50 are shown connected to the controller 40, with the activation receiver 52 (FIG. 3) also connected via connector 80 to the controller 40. Provision is made for four inputs to the analog or digital configurable input ports of the controller 40 via connector 84. Connector 86 allows the connection of the controller 40 to a programming station, to program the controller 40 with executable code.

Figure 4:
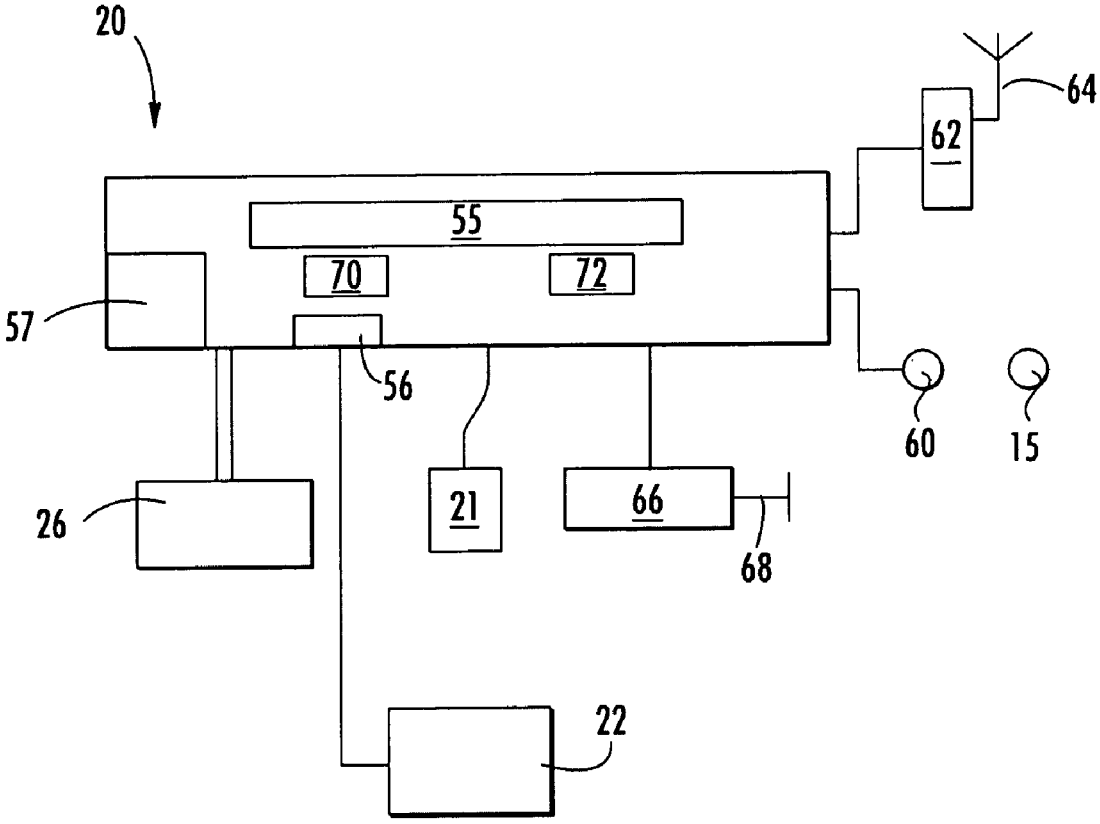
FIG. 4 shows a schematic block diagram of a programming unit, according to one embodiment of the present invention.

Referring to FIG. 4, there is illustrated a handheld programming unit 20, according to one embodiment of the present invention. The programming unit 20 includes a power supply 26, such as a battery, for supplying power to the programming unit. The programming unit 20 further includes a liquid crystal display (LCD) 55 and a configuration interface 56 in the form of an RS232 serial interface through which the programming unit is connected to the controller 22 of the interface unit 14 (illustrated in FIG. 2). The programming unit 20 also includes a controller 57, such as a processor operating under software control, and a data transfer interface 60 which is connectable to the data key 15 so that the data key is in operable communication with the programming unit. The programming unit 20 further includes a data repository 21 comprising computer-readable memory in operable communication with the controller 57. The programming unit 20 further includes a receiver 62, such as a radio-frequency receiver, matched to the transmitter 48 of the monitoring unit 10. The receiver 62 includes an antenna 64 which generally needs to be located within the line of sight of the transport container. The programming unit 20 further includes a transmitter 66, such as a low-frequency, radio-frequency transmitter, having an antenna 68 which generally needs to be located in close proximity with the antenna 54 of the receiver 52 of the monitoring unit 10.

Figure 6A:
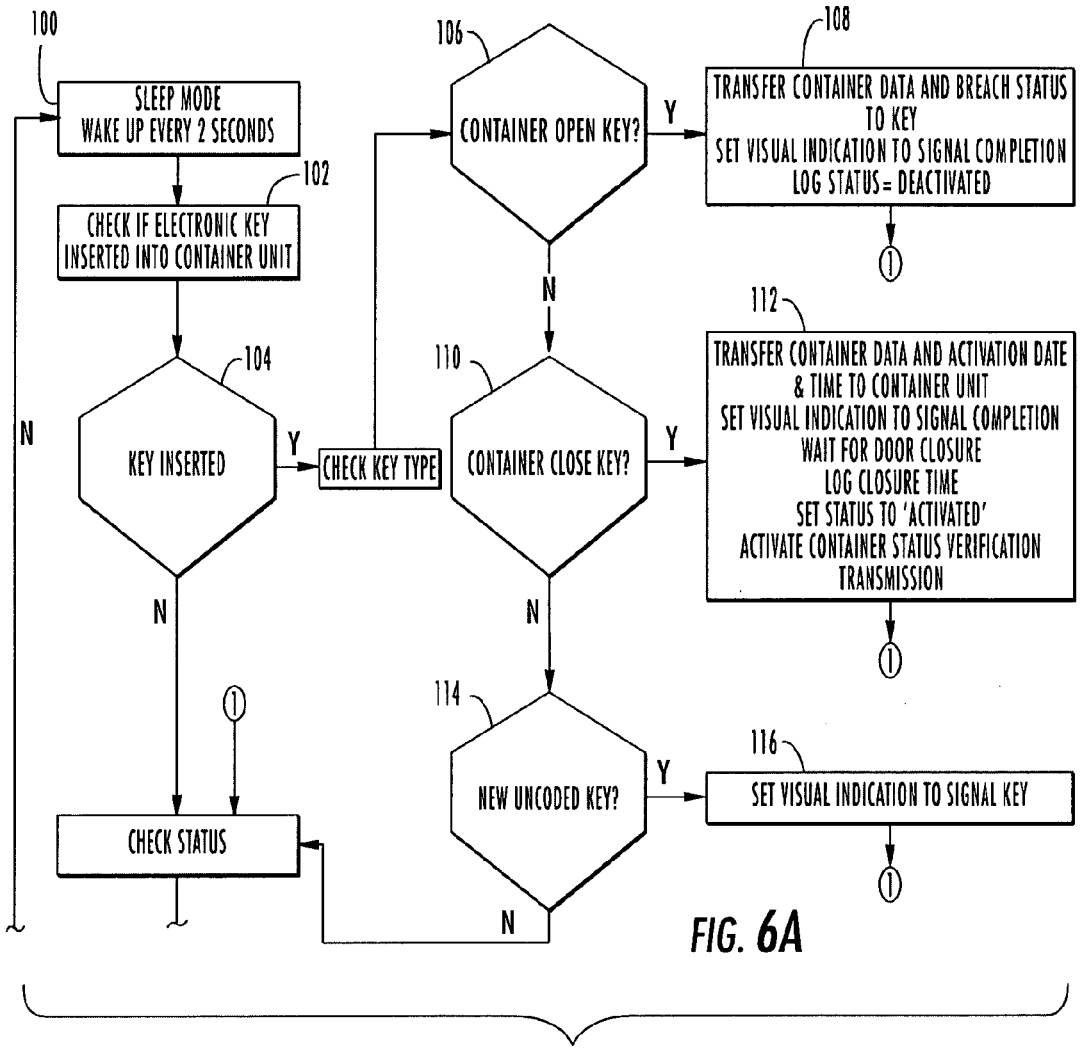
FIGS. 6A and 6B show a flow diagram of the operations performed by the monitoring unit, according to one embodiment of the present invention.
Figure 6B:
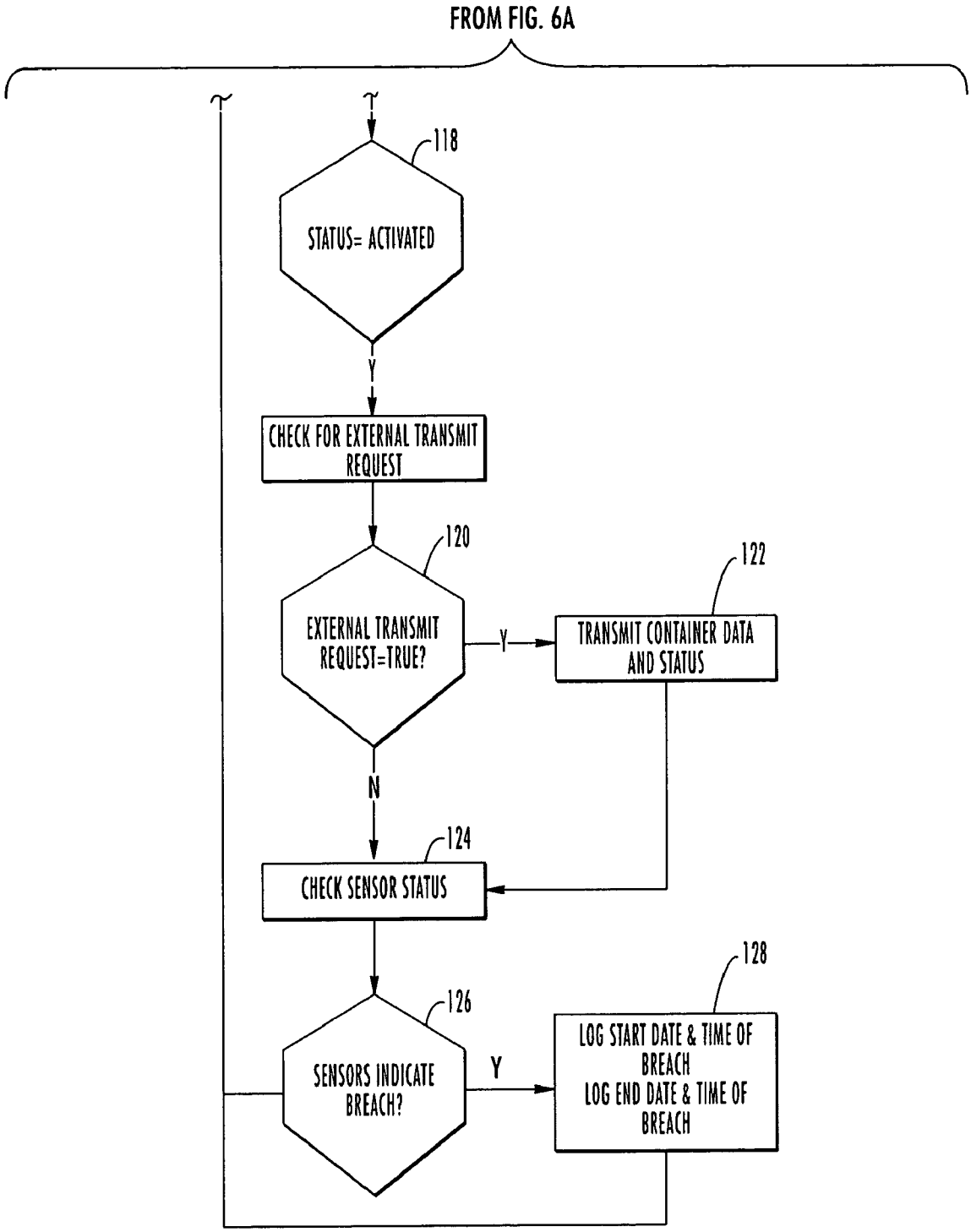

Referring to FIGS. 6A and 6B, there are illustrated the operations performed by the controller 40 of the monitoring unit 10, according to one embodiment of the present invention. The controller 40 is normally in a sleep mode, see Block 100, which is a reduced activity power saving mode. This mode saves power consumption from the power supply 44, thereby extending the life of the power supply. At predetermined time intervals, such as once every two seconds, the controller 40 wakes up, see Block 102, and checks the data transfer interface 46 for the presence of a data key 15. If a data key 15 is detected, see Block 104, the memory of the data key 15 is checked to determine which type of key it is, see Block 106. Depending on the type of information stored on the data key 15, the data key can either be configured as an activation key 16 or a de-activation key 18, or it can be of unknown origin. If the data key 15 is a deactivation key 18, see Block 108, the data that is stored in the data repository 42 of the monitoring unit 10 is transferred to the deactivation key 18. The data transferred to the deactivation key 18 can include the activation code, the deactivation code, data corresponding to the transport container, and/or data corresponding to the incidents of access to the transport container. According to one embodiment, this data can be downloaded or transferred only once. The status of the controller 40 of the monitoring unit 10 is set to "deactivated" and the LED which is connected via connector 80 (see FIG. 5A) indicates that the monitoring unit 10 is deactivated.

If the data key 15 is not a deactivation key 18, the data key is checked to determine if the data key is an activation key 16. See Block 110. If the data key 15 is an activation key 16, the data corresponding to the transport container and the activation code is transferred from the activation key 16 to the data repository 42 of the monitoring unit 10. See Block 112. As discussed above, the activation code comprises a unique code that is generated by the programming unit 20. Preferably, the date and time of activation is stored in the data repository 42 of the monitoring unit 10 by the controller 40. See Block 112. In one embodiment, the LED port 80 is activated to flash the LED (not shown) with a two second on-off duty cycle, indicating that the monitoring unit 10 has been activated. See Block 112. The controller 40 then waits for the container door (not shown) to be closed, for example, as monitored by the magnetic switch 38 (FIG. 3), before the activation cycle is completed. If the data key 15 is not an activation key 16, see Block 114, the controller 40 assumes that the data key is unconfigured and the LED is activated accordingly via connector 80, see Block 116. After completing each subroutine in 108, 112 and 116, operation of the controller 40 returns to 118.

If a data key 15 is not inserted into the data transfer interface 46 of the monitoring unit 10, then the status of the monitoring unit is checked by the controller 40. See Block 118. If the monitoring unit 10 is not activated, the controller 40 goes back to sleep. See Block 100. If the monitoring unit 10 is activated, the controller 40 queries or checks if the activation receiver 52 received an activation signal from the transmitter 66 of the programming unit 20 of the interface unit 14. If the activation receiver 52 received an activation signal, see Block 120, the controller 40 instructs the transmitter 48 to transmit the data from the data repository 42 corresponding to the access incidents to the receiver 62 of the programming unit 20 or, according to the embodiment illustrated in FIG. 2A, instructs the transmitter 27 to transmit the data to the relay unit 28, as discussed above. See Block 122. The controller 40 checks the sensors 12. See Block 124. If the sensors 12 indicate an access incident has occurred, see Block 126, the access incident is stored by the controller 40 in the data repository 42, including data corresponding to the time and date at which the access incident started and the time and date at which the access incident ended. See Block 128. Thereafter, the controller 40 goes back to sleep. See Block 100.

Figure 7:
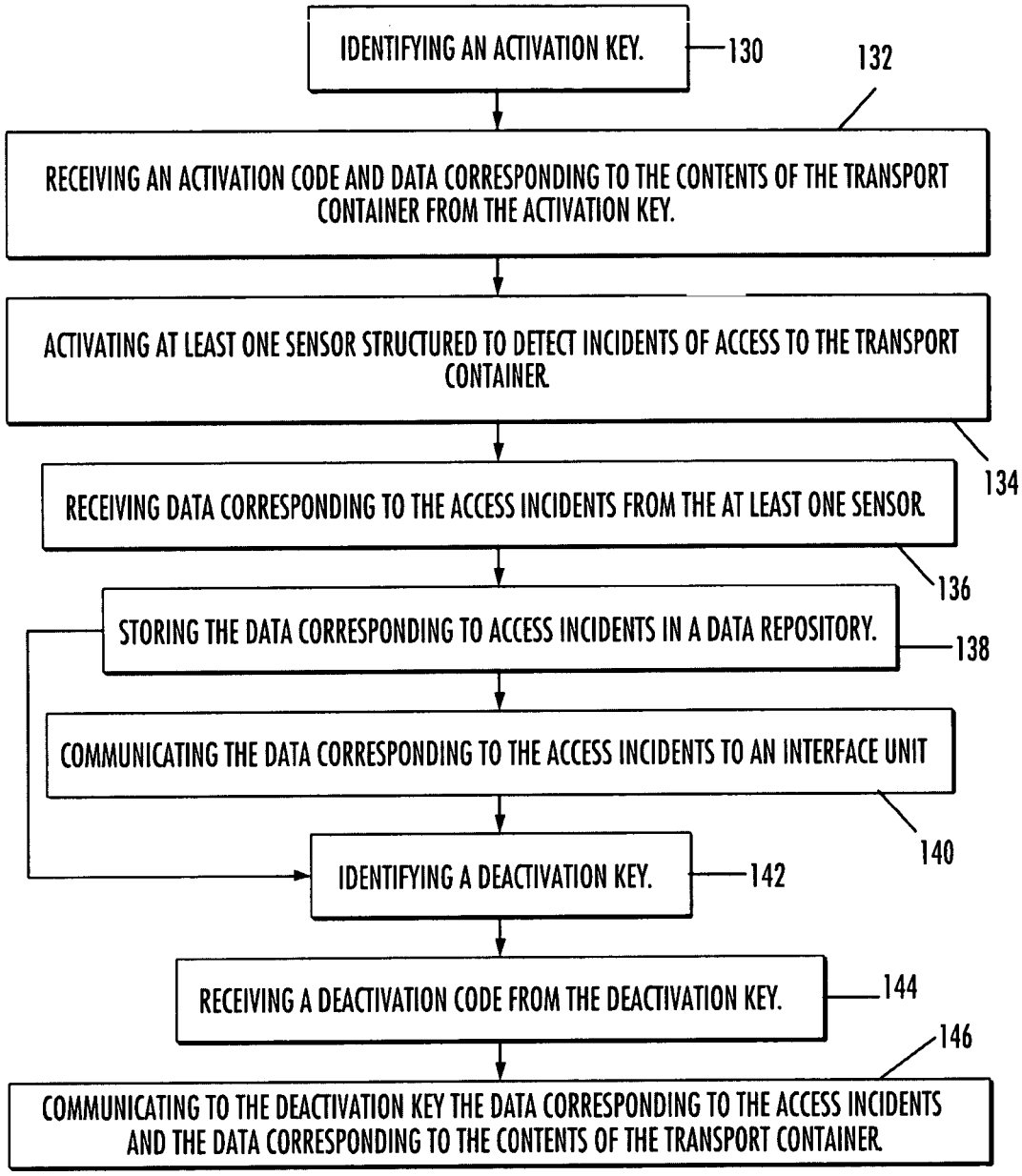
FIG. 7 shows a flow diagram of the operations performed by the monitoring unit, according to another embodiment of the present invention.

Referring to FIG. 7, there is illustrated a method for monitoring a transport container, according to another embodiment of the invention. The method includes identifying an activation key. See Block 130. An activation code and data corresponding to the contents of the transport container are received from the activation key. See Block 132. At least one sensor structured to detect incidents of access to the transport container is activated. See Block 134. Data corresponding to the access incidents is received from the at least one sensor. See Block 136. The data corresponding to access incidents is stored in a data repository. See Block 138. The data corresponding to the access incidents is communicated to an interface unit. See Block 140. A deactivation key is identified. See Block 142. A deactivation code is received from the deactivation key. See Block 144. Data corresponding to the access incidents and data corresponding to the contents of the transport container is communicated to the deactivation key. See Block 146.

Figure 8:
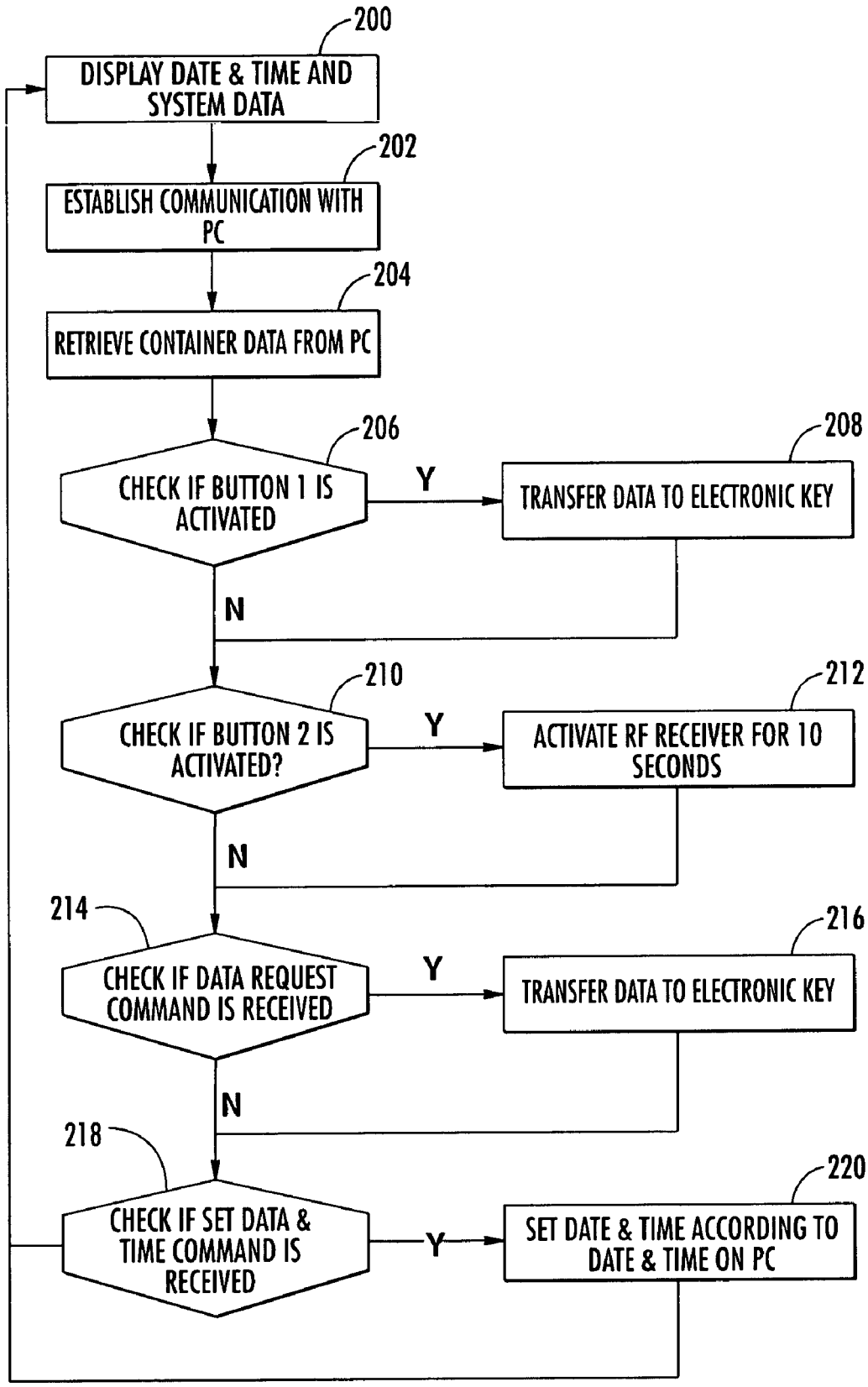
FIG. 8 shows a flow diagram of the operations performed by a programming unit, according to one embodiment of the present invention.

Referring to FIG. 8, there is illustrated the operation of the programming unit 20, according to one embodiment of the present invention. When the programming unit 20 is switched on, controller 57 instructs the LCD 55 to display the time, date and system data. See Block 200. If the controller 57 detects a connection to a controller 22 through the configuration interface 56, the controller 57 establishes a connection link therewith. See Block 202. The data corresponding to the transport container is then transferred from the data repository 24 associated with the controller 22 to the data repository 21 of the programming unit 20. See Block 204. Thereafter, the user depresses the download data button 70 of the programming unit 20, see Block 206, to thereby communicate or transfer the data corresponding to the transport container from the data repository 21 of the programming unit to the data transfer interface 60, which transfers the data to the data key 15 (and thereby configures the data key 15 into an activation key 16). See Block 208. In addition to the data corresponding to the transport container, the programming unit 20 also communicates or transfers to the activation key 16 the activation code, which is uniquely associated with the person entering the data on the programming unit, such as through the user's user name and/or password. See Block 208.

To access the data corresponding to the access incidents, the user of the programming unit 20 depresses the receive data button 72 of the programming unit to transmit an activation signal from the transmitter 66 of the programming unit to the activation receiver 52 of the monitoring unit 10. See Block 210. Upon receipt of the activation signal by the receiver 52, which is communicated to the controller 40 of the monitoring unit 10, the controller 40 instructs the data repository 42 to communicate or transfer the data corresponding to access incidents from the data repository 42 to the transmitter 48 of the monitoring unit, which in turn communicates or transmits the data corresponding to the access incidents to the receiver 62 of the programming unit 20. See Block 212.

According to one embodiment, the controller 57 queries or checks the configuration interface 56 to determine if a "data request command" has been received from the controller 22. See Block 214. If a "data request command" was received from the controller 22, the data key 15 is programmed with the data received from the controller 22. See Block 216. The data can include the data corresponding to the transport container, such as the container ID, manifest number and destination port number, etc.

According to one embodiment, the controller 57 queries or checks the configuration interface 56 to determine if a "set date and time command" has been received from the controller 22. See Block 218. If a "set date and time command" was received from the controller 22, the programming unit 20 is programmed with the current date and time. See Block 220.

Figure 9:
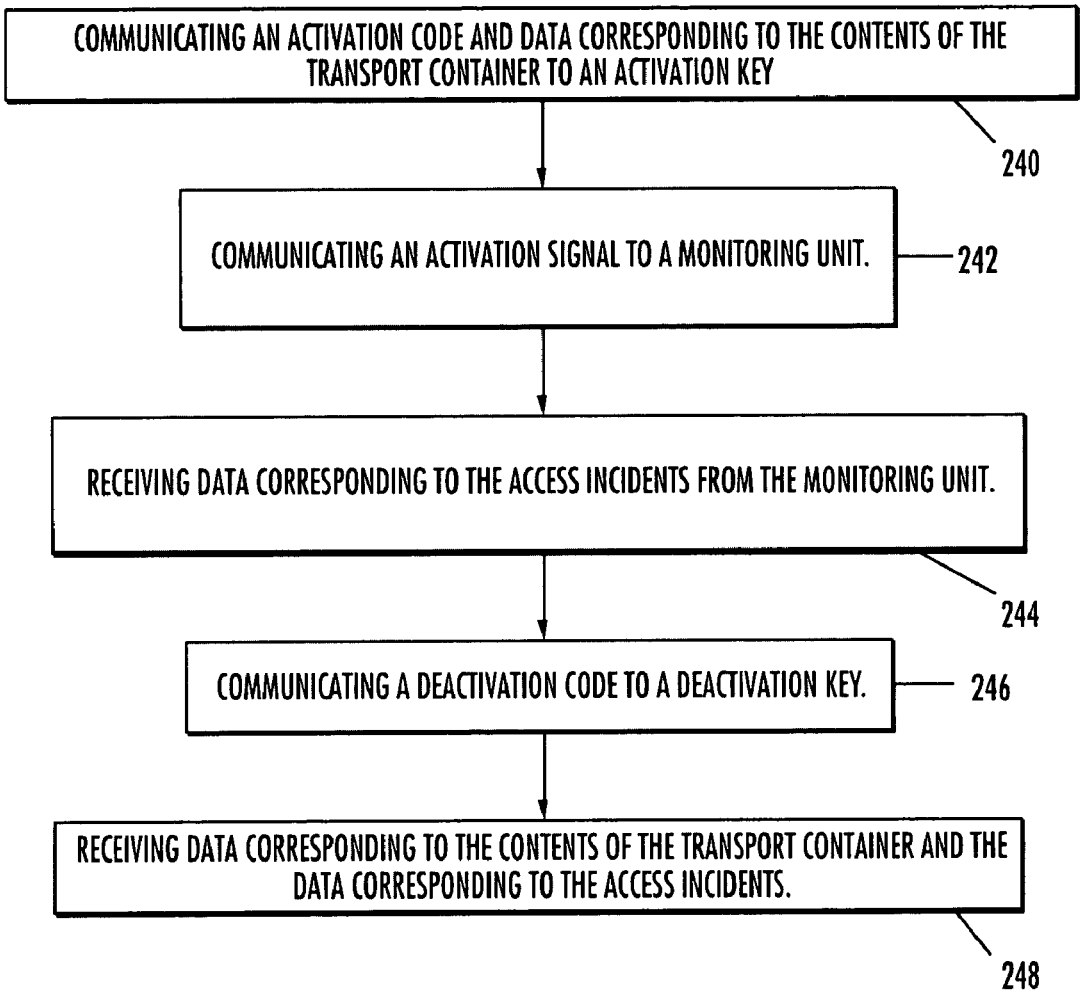
FIG. 9 shows a flow diagram of the operations performed by a programming unit, according to another embodiment of the present invention.

According to another embodiment of the present invention, there is illustrated in FIG. 9 a method for activating and deactivating a monitoring unit for monitoring access to a transport container. The method comprises communicating an activation code and data corresponding to the contents of the transport container to an activation key. See Block 240. An activation signal is communicated to a monitoring unit. See Block 242. Data corresponding to the access incidents is received from the monitoring unit by an interface unit. See Block 244. According to another embodiment, a deactivation code is communicated to a deactivation key. See Block 246. Thereafter, data corresponding to the contents of the transport container and the data corresponding to the access incidents is received by the deactivation key. See Block 248.

In use, after installation of the monitoring unit 10, transport containers can be loaded with freight or cargo. The freight manifest is completed according to the freight or cargo that is to be transported. Data corresponding to the transport container, such as the freight manifest, destination, etc. is inputted (either manually or electronically) to the controller 22 and stored in the data repository 24. The programming unit 20 is plugged into an RS232 port of the controller 22. Upon detection of the controller 22, the programming unit 20 transfers the data corresponding to the transport container and stores the data in the data repository 21. The programming unit 20 generates an activation code which is uniquely associated with the operator of the programming unit through a user name and password. According to one embodiment, the activation code and data corresponding to the transport container is combined. A data key 15 is connected to the data transfer interface 60 of the programming unit 20 and the download data button 70 is pressed causing the data transfer interface 60 to transfer the data to the data key 15. The data key 15 is now configured as an activation key 16.

The activation key 16 is connected to the data transfer interface 46 of the monitoring unit 10, which causes the monitoring unit to transfer the activation code and data corresponding to the transport container. The operator is allowed a certain period of time, such as fifteen (15) seconds, to close and secure the container doors, which will cause the container monitoring unit 10 to go into its activated mode. From the moment that the container doors are closed and secured, the monitoring cycle is started and any violations sensed by sensor(s) 12 will be stored with a time and date stamp in the data repository 42 of the monitoring unit 10, as well as any other pertinent information that may be desired, such as the corresponding geographic location, duration, etc. Therefore, any attempt to interfere or change the freight contents or otherwise obtain access to the transport container in which the monitoring unit 10 is installed and in its activated mode will trigger an access incident to be stored.

At the destination, after offloading the transport container from a ship, truck, aircraft or other vehicle, the transmitter 66 of the programming unit 20 generates a low-frequency, radio-frequency transmission which when received by the activation receiver 52 of the monitoring unit 10 causes the monitoring unit to enter a data download or transfer mode. The monitoring unit 10 transmits data corresponding to any access incidents via the transmitter 48. The transmissions are received by the receiver 62 of the programming unit 20. If any access incidents are recorded, the transport container can be placed in a quarantine area and can be thoroughly searched. At the destination, the operator connects another data key 15 to the data transfer interface 60 of the programming unit 20 to configure the data key as a deactivation key 18. More specifically, data transfer interface 60 of the programming unit 20 transmits to the data key 15 a deactivation code that is uniquely associated with the operator of the programming unit 20, such as by user name and/or password. The container doors are opened and within a certain period of time, such as fifteen (15) seconds, the deactivation key 18 is pressed against the data transfer interface 46 of the monitoring unit 10. The controller 40 of the monitoring unit 10 identifies the deactivation key 18 from the deactivation code. After the controller 40 stores the deactivation code of the operator in the data repository 42, the controller 40 deactivates the monitoring cycle. Comprehensive data corresponding to any stored access incidents, the data corresponding to the transport container, the activation code and deactivation code are then communicated or transferred by the controller 40 from the data repository 42 to the deactivation key 18 via the data transfer interface 46. As discussed above, the data corresponding to any stored access incidents, the data corresponding to the transport container, the activation code and deactivation code can in turn be transferred to the programming unit 20.

At the destination, the programming unit 20 can be connected to the controller 22 wherein the data corresponding to any stored access incidents, the data corresponding to the transport container (including the time of activation and deactivation of the monitoring unit), the activation code (operator identity) and deactivation code (operator identity) can be transferred to the data repository 24 and disseminated to interested parties. The combination of this data will give comprehensive data on the transport container while it was being transported.

FIGS. 1, 2, 2A, 3, 4, 6, 7, 8, and 9 are block diagrams, flowcharts and control flow illustrations of methods, systems and program products according to the invention. It will be understood that each block or step of the block diagrams, flowcharts and control flow illustrations, and combinations of blocks in the block diagrams, flowcharts and control flow illustrations, can be implemented by computer program instructions. These computer program instructions may be loaded onto, or otherwise executable by, a computer or other programmable apparatus to produce a machine, such that the instructions which execute on the computer or other programmable apparatus create means or devices for implementing the functions specified in the block diagrams, flowcharts or control flow block(s) or step(s). These computer program instructions may also be stored in a computer-readable memory that can direct a computer or other programmable apparatus to function in a particular manner, such that the instructions stored in the computer-readable memory produce an article of manufacture, including instruction means or devices which implement the functions specified in the block diagrams, flowcharts or control flow block(s) or step(s). The computer program instructions may also be loaded onto a computer or other programmable apparatus to cause a series of operational steps to be performed on the computer or other programmable apparatus to produce a computer implemented process such that the instructions which execute on the computer or other programmable apparatus provide steps for implementing the functions specified in the block diagrams, flowcharts or control flow block(s) or step(s).

Accordingly, blocks or steps of the block diagrams, flowcharts or control flow illustrations support combinations of means or devices for performing the specified functions, combinations of steps for performing the specified functions and program instruction means or devices for performing the specified functions. It will also be understood that each block or step of the block diagrams, flowcharts or control flow illustrations, and combinations of blocks or steps in the block diagrams, flowcharts or control flow illustrations, can be implemented by special purpose hardware-based computer systems which perform the specified functions or steps, or combinations of special purpose hardware and computer instructions.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Although specific terms are employed herein, they are used in a generic and descriptive sense only and not for purposes of limitation.

That which is claimed:

1. A system for monitoring access to a transport container, comprising:

a monitoring unit secured to the transport container;

at least one sensor in operable communication with said monitoring unit, said at least one sensor being structured to detect incidents of access to the transport container and to communicate data corresponding to the access incidents to said monitoring unit;

an interface unit being configured to communicate with said monitoring unit;

at least one activation key configured to communicate with said monitoring unit and being configured by said interface unit to activate said monitoring unit using an activation code so that said monitoring unit begins to monitor access to the transport container;

at least one deactivation key configured to communicate with said monitoring unit and being configured by said interface unit to deactivate said monitoring unit using a deactivation code; and wherein said monitoring unit is configured to communicate data corresponding to the access incidents to said interface unit.

2. A system according to claim 1, wherein said monitoring unit comprises:

a controller, said controller being configured to communicate with said at least one sensor, said activation key and said deactivation key;

a power supply in operable communication with said controller;

a data repository in operable communication with said controller and being structured to store the data corresponding to access incidents;

a transmitter in operable communication with said controller, said transmitter being configured to communicate data corresponding to the access incidents to said interface unit; and a receiver in operable communication with said controller, said receiver being configured to receive communications from said interface unit.

3. A system according to claim 1, wherein said interface unit is configured to communicate to said activation key an activation code and data corresponding to the contents of the transport container, and wherein said activation key is configured to communicate the activation code and data corresponding to the contents of the transport container to said monitoring unit.

4. A system according to claim 3, wherein the activation code comprises data corresponding to the operator of said interface unit communicating with said activation key.

5. A system according to claim 1, wherein said interface unit is configured to communicate to said deactivation key a deactivation code, and wherein said deactivation key is configured to communicate the deactivation code to said monitoring unit.

6. A system according to claim 5, wherein the deactivation code comprises data corresponding to the operator of said interface unit communicating with said deactivation key.

7. A system according to claim 5, wherein said monitoring unit is configured to communicate to said deactivation key the data corresponding to the contents of the transport container and the data corresponding to the access incidents.

8. A system according to claim 7, wherein said deactivation key is configured to communicate to said interface unit the data corresponding to the contents of the transport container and the data corresponding to the access incidents.

9. A system according to claim 7, wherein said monitoring unit is configured to communicate to said deactivation key data corresponding to the operator of said interface unit communicating with said activation key and data corresponding to the operator of said interface unit communicating with said deactivation key, and wherein said deactivation key is configured to communicate to said interface unit the data corresponding to the contents of the transport container, data corresponding to the access incidents, data corresponding to the operator of said interface unit communicating with said activation key, and data corresponding to the operator of said interface unit communicating with said deactivation key.

10. A system according to claim 1 wherein said monitoring unit is configured to communicate the data corresponding to the access incidents to said interface unit through wireless communication.

11. A system according to claim 1 wherein said monitoring unit is configured to communicate the data corresponding to the access incidents to said interface unit through low-earth orbiting satellite communication.

12. A system according to claim 1 wherein said interface unit comprises at least one programming unit and a second controller, said at least one programming unit being configured to communicate with said second controller.

13. A system according to claim 1 wherein said at least one sensor comprises a sensor selected from the group consisting of an infrared motion sensor, an optical sensor, a temperature sensor, a sound sensor, a vibration sensor, a magnetic switch, and a radiation sensor.

14. A system for monitoring access to a transport container, comprising:

a monitoring unit secured to the transport container;

at least one sensor in operable communication with said monitoring unit, said at least one sensor being structured to detect incidents of access to the transport container and to communicate data corresponding to the incidents to said monitoring unit; and at least one data key configured to communicate with said monitoring unit, said at least one data key is capable of being configured an activation key or a deactivation key, wherein said activation key is configured to activate said monitoring unit using an activation code so that said monitoring unit begins to monitor access to the transport container, and said deactivation key is configured to deactivate said monitoring unit using a deactivation code; and wherein said monitoring unit is configured to communicate data corresponding to the access incidents to said deactivation key.

15. A system according to claim 14, wherein said monitoring unit comprises:

a controller, said controller being configured to communicate with said at least one sensor, said activation key and said deactivation key;

a power supply in operable communication with said controller; and a data repository in operable communication with said controller and being structured to store the data corresponding to access incidents.

16. A system according to claim 14, wherein said activation key comprises a data repository, said data repository storing an activation code and data corresponding to the contents of the transport container, and wherein said activation key is configured to communicate the activation code and data corresponding to the contents of the transport container to said monitoring unit.

17. A system according to claim 14, wherein said deactivation key comprises a data repository, said data repository storing a deactivation code.

18. A system according to claim 14, wherein said monitoring unit is structured to communicate to said deactivation key the data corresponding to the contents of the transport container.

19. A system according to claim 14 wherein said at least one sensor comprises a sensor selected from the group consisting of an infrared motion sensor, an optical sensor, a temperature sensor, a sound sensor, a vibration sensor, a magnetic switch, and a radiation sensor.

20. A computer program product for monitoring access to a transport container, the computer program product comprising a computer-readable storage medium having computer-readable program code portions stored therein, the computer-readable program portions comprising:

an executable portion for identifying an activation code from an activation key, said executable portion activates at least one sensor structured to detect incidents of access to the transport container, said executable portion receives data corresponding to the access incidents from the at least one sensor, said executable portion identifies a deactivation code from a deactivation key, and wherein said executable portion communicates the data corresponding to the access incidents to the deactivation key.

21. A computer program product according to claim 20 wherein said executable portion stores the data corresponding to access incidents in a data repository.

22. A computer program product according to claim 20 wherein said executable portion receives an activation code and data corresponding to the contents of the transport container from the activation key.

23. A computer program product according to claim 20 wherein said executable portion communicates the data corresponding to the access incidents to an interface unit.

24. A computer program product according to claim 20 wherein said executable portion receives a deactivation code from the deactivation key.

25. A computer program product according to claim 20 wherein said executable portion communicates to the deactivation key the data corresponding to the contents of the transport container.

26. A computer program product for activating and deactivating a monitoring unit for monitoring access to a transport container, the computer program product comprising a computer-readable storage medium having computer-readable program code portions stored therein, the computer-readable program portions comprising:

an executable portion for communicating an activation code and data corresponding to the contents of the transport container to an activation key, said executable portion receives data corresponding to the access incidents from the monitoring unit, said executable portion communicates a deactivation code to a deactivation key.

27. A computer program product according to claim 26 wherein said executable portion receives data corresponding to the contents of the transport container and the data corresponding to the access incidents.

28. A method for monitoring access to a transport container, comprising:

identifying an activation code from an activation key;

activating at least one sensor structured to detect incidents of access to the transport container;

receiving data corresponding to the access incidents from the at least one sensor;

identifying a deactivation code from a deactivation key; and communicating the data corresponding to the access incidents to the deactivation key.

29. A method according to claim 28 further comprising storing the data corresponding to access incidents in a data repository.

30. A method according to claim 28 further comprising receiving an activation code and data corresponding to the contents of the transport container from the activation key.

31. A method according to claim 28 further comprising communicating the data corresponding to the access incidents to an interface unit.

32. A method according to claim 28 wherein said second identifying step comprises receiving a deactivation code from the deactivation key.

33. A method according to claim 28 further comprising communicating to the deactivation key the data corresponding to the contents of the transport container.

34. A method for activating and deactivating a monitoring unit for monitoring access to a transport container, comprising:

communicating an activation code and data corresponding to the contents of the transport container to an activation key;

receiving data corresponding to the access incidents from the monitoring unit; and communicating a deactivation code to a deactivation key.

35. A method according to claim 34 further comprising subsequent to said third communicating step, receiving data corresponding to the contents of the transport container and the data corresponding to the access incidents.

* * * * *

UNITED STATES PATENT AND TRADEMARK OFFICE

CERTIFICATE OF CORRECTION

PATENT NO. : 7,154,390 B2
APPLICATION NO. : 10/500097
DATED : December 26, 2006
INVENTOR(S) : Giermanski et al.

It is certified that error appears in the above-identified patent and that said Letters Patent is hereby corrected as shown below:

Title page,

Insert the following
item
--(30) Foreign Applicaion Priority Data

Mar. 20, 2003 (ZA) 20032250--.

Signed and Sealed this

Tenth Day of April, 2007

JON W. DUDAS
*Director of the United States Patent and Trademark Office*